United States Patent [19]

Petterson

[11] 4,081,781

[45] Mar. 28, 1978

[54] STRIP POTENTIOMETER

[76] Inventor: Tor H. Petterson, 31248 Palos Verdes Dr. West, Palos Verdes Peninsula, Calif. 90274

[21] Appl. No.: 715,899

[22] Filed: Aug. 19, 1976

[51] Int. Cl.[2] ..... H01C 10/00

[52] U.S. Cl. ..... 338/196; 116/124.1 A; 338/125; 338/130; 338/227

[58] Field of Search ..... 338/92, 97, 196, 122, 338/123, 125, 130, 138, 118, 119, 227, 308, 314; 116/124.1 A, 124.1 R

[56] References Cited

U.S. PATENT DOCUMENTS 2,860,215 11/1958 Williams ..... 338/196 X

*Primary Examiner*—C. L. Albritton

*Attorney, Agent, or Firm*—Edward A. Sokolski

[57] ABSTRACT

An elongated tape fabricated of an electrically insulative material has a pair of strips which run therealong, these two strips being joined together at one end thereof but not at the other, to form an open loop. The strips are fabricated of an electrically conductive material having a relatively high resistivity. The opposite ends of the tape are each wound on a separate reel, the tape being fed from one reel to the other by means of a drive mechanism. The tape is marked along its length with indicia representing resistances between the two strips for each position of the tape between the two reels. A window with a marker is provided to read out these resistances. A pair of electrical wipers are mounted in contact with the pair of strips to connect the strips to a circuit or the like, in which the resistance is to be utilized.

13 Claims, 7 Drawing Figures

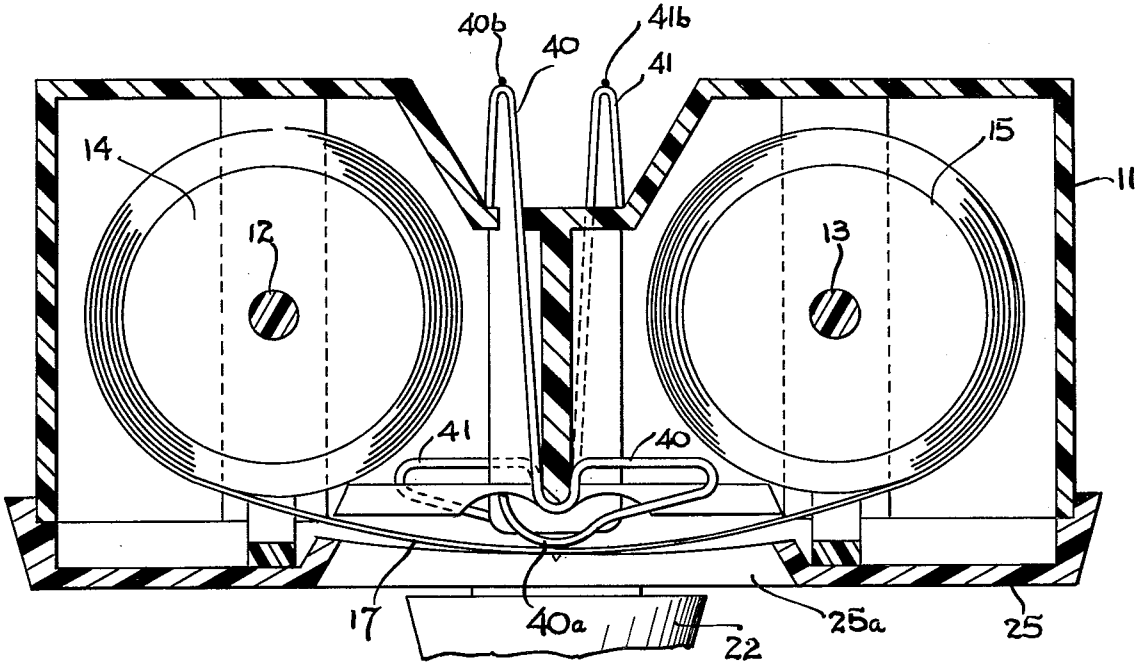
FIG. 4
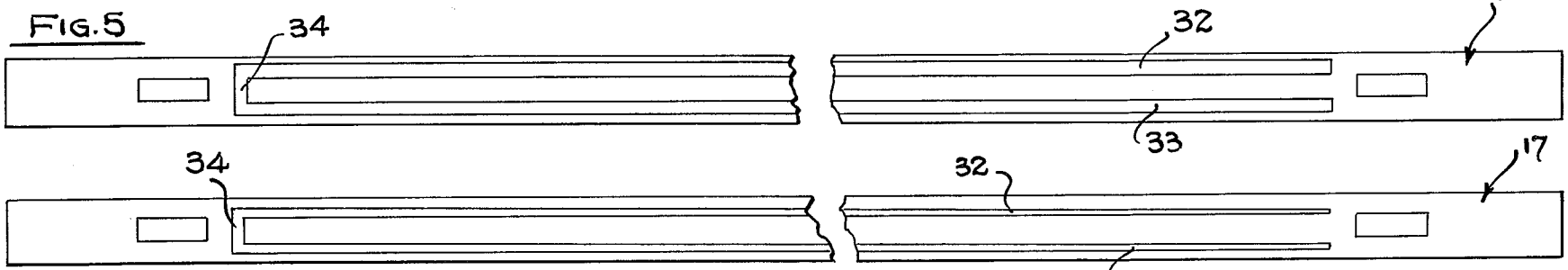
FIG. 5
FIG. 6
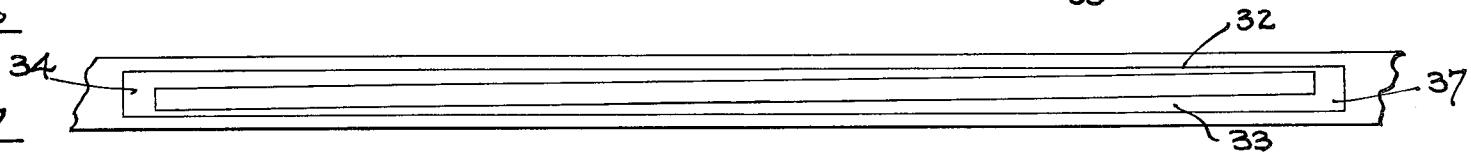
FIG. 7

STRIP POTENTIOMETER

This application relates to electrical potentiometers, and more particularly to such a potentiometer utilizing wipers which contact conductive strips having a relatively high resistivity placed on an elongated tape having indicia of resistance marked thereon, the tape being transferred between a pair of reels.

Various types of variable resistance devices have been developed in the prior art utilizing both rotational and linear adjustment means. These devices generally use a wiper which either moves along the conductive surface of a material such as carbon or along a conductive wire. It is difficult in most of these devices to provide a highly accurate repeatable resistance output or an accurate indicia of such output for various settings of the device. Devices of the prior art providing such features are generally overly expensive and complicated in their construction.

In U.S. Pat. No. 2,860,215, a device is described utilizing a strip conductive element which is wound between a pair of reels and which has indicia of resistance marked on the strip. In this device, a wiper slides along the conductive element with the resistive output being provided between the contact point of this wiper and one end of such element. The present invention is an improvement over that of the aforementioned patent in that it provides a simpler, more economical device capable of highly compact construction and highly accurate and reliable resistance outputs. The improvement of the present invention is achieved by utilizing a tape having paired resistive strips thereon formed in a loop, in conjunction with a pair of electrical wipers, thereby eliminating the rotational electrical connection on the end of the strip. Further, the device of the present invention employs a simple drive mechanism for the tape on which the resistive strips are placed.

It is therefore an object of this invention to provide an improved potentiometer having a highly accurate output and a continuous indication of the value of such output.

It is a further object of this invention to provide a highly accurate potentiometer of simpler and more economical construction.

It is still another object of this invention to facilitate the generation of accurate resistances and to provide an indication of the value of such resistances.

Other objects of this invention will become apparent as the description proceeds in connection with the accompanying drawings, of which:

FIG. 4 is a cross-sectional view taken along the plane indicated by 4—4 in FIG. 2;

FIG. 5 is a view illustrating one type of tape and associated strips that may be utilized in the preferred embodiment;

FIG. 6 is a view illustrating a second type of tape and associated strips which may be utilized in the preferred embodiment; and FIG. 7 is a view illustrating a pair of strips formed in a closed loop configuration.

Briefly described, my invention is as follows: Placed along an elongated tape of electrically insulative material are a pair of resistive strips which are joined together at at least one end thereof, and may be left open at the other, to form a loop. The opposite ends of the tape are wound around a pair of reels which are preferably spring urged so as to provide a small amount of tension on the tape to take up any slack therein, and to maintain it tightly wound around the reels. The tape is moved between the two reels by means of a drive wheel which engages the tape and which is driven by a manually operated knob. An electrical wiper is mounted in contact with each of the strips to provide means for coupling the resistive output of the device to a circuit in which it is to be utilized. Indicia are marked along the tape to continuously indicate the resistance between the wipers for various positions of the tape as it is moved between the two reels. The resistive strips may be fabricated to provide linear, non-linear, or outputs in accordance with other functions that may be desired.

Figure 3:
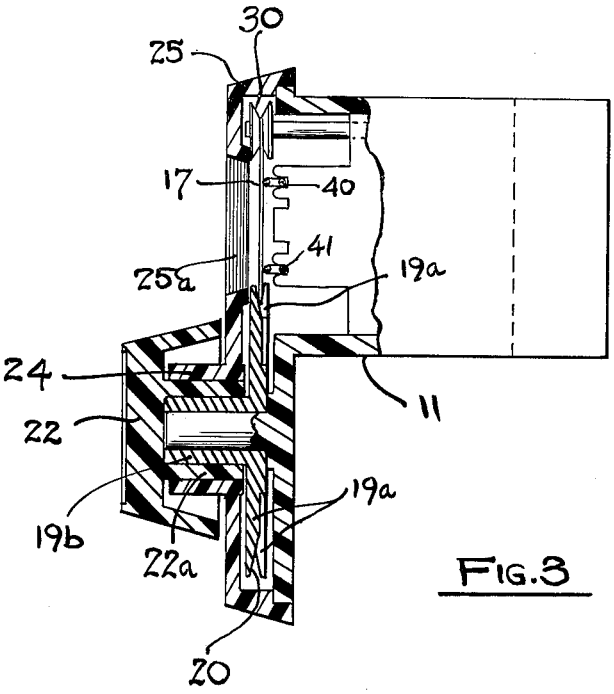
FIG. 3 is a cross-sectional view taken along the plane indicated by 3—3 in FIG. 2.
Figure 2:
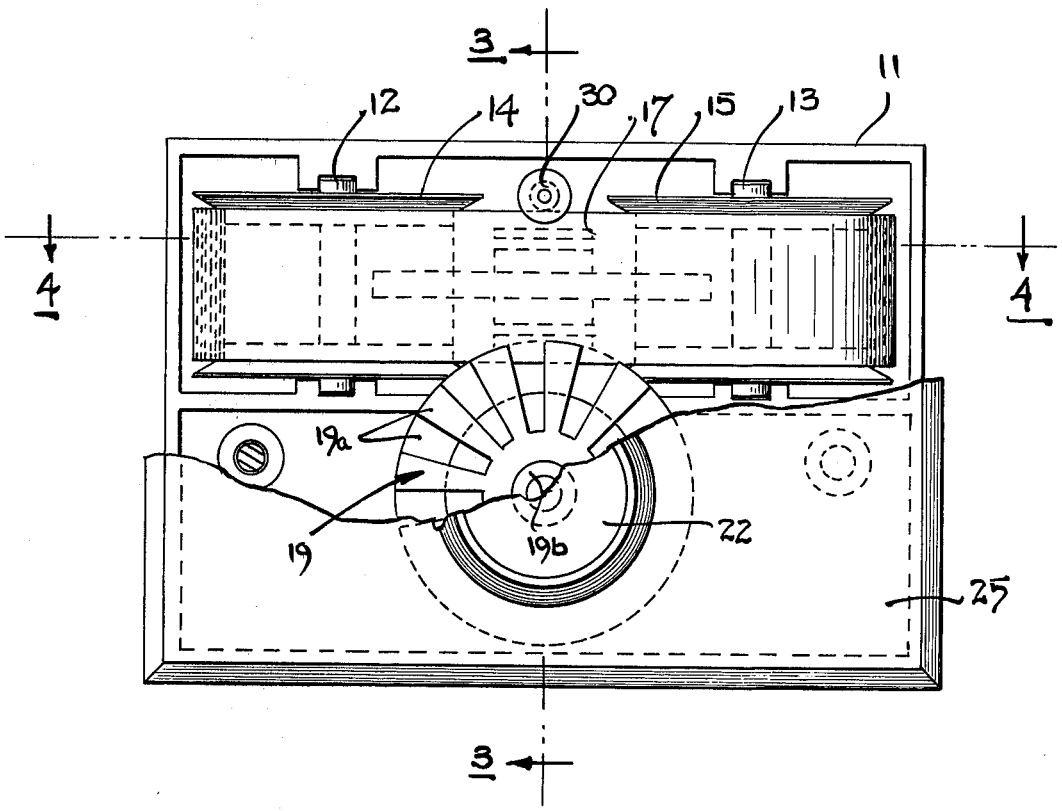
FIG. 2 is an elevational view with partial cutaway section of the preferred embodiment.

Referring now to the figures, a preferred embodiment of the invention is illustrated. Rotatably mounted within housing 11 on axles 12 and 13 are a pair of reels 14 and 15 respectively. Reels 14 and 15 may be biased in opposite directions by means of springs or the like (not shown), to take up any slack in tape 17 which is wound therearound. Tape 17 is preferably precoiled to provide self coiling and biasing around the spools and is driven in either direction by means of pinch wheel 19, or rack and pinion which engages the edges thereof. Pinch wheel 19 has a plurality of fingers **19*a* which are alternately bent in opposite directions to form slots 20 therebetween (see FIG. 3), the tape 17 being fitted in these slots. Pinch wheel 19 has a cylindrical portion 19*b* which is rotatably supported via knob 22 in bushing 24 fixedly attached to the front plate of casing 11. Knob 22 is fixedly attached to cylindrical shaft 19*b* through suitable means such as a set screw (not shown). Knob 22 has a cylindrical sleeve portion 22*a* which fits between cylindrical pinch wheel portion 19*b* and bushing 24, sleeve portion 22*a* thus riding on bushing 24. Front plate 25 has a window 25*a* therein behind which the tape 17 passes as knob 22 is rotated. Guide means in the form of idler wheel 30 is rotatably supported on the casing and acts as a guide for the upper edge of tape 17**.

Figure 1:
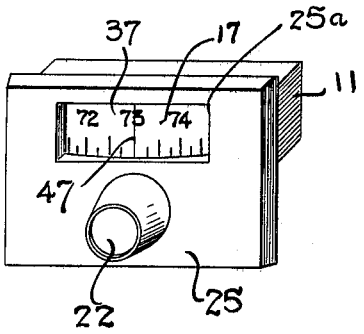
FIG. 1 is a perspective view illustrating a preferred embodiment of the invention.

Referring now to FIG. 5, one particular form of tape that may be utilized in my invention is illustrated. Tape 17 is made of a suitable flexible material which is electrically insulative and has a pair of electrically resistive strips 32 and 33 thereon. Strips 32 and 33 may be deposited on the tape, laminated, etched or adhered thereto with a suitable adhesive. Strips 32 and 33 may be of a resistive material such as Nichrome. The strips are connected together at at least one end thereof by means of a "jumper" strip 34, and may be left open at the opposite end to form an open loop. The side of tape 17 opposite to that on which strips 32 and 33 are located has indicia 37 marked thereon (see FIG. 1) indicating resistance values between the strip portions thereopposite.

A pair of electrical wipers 40 and 41 are mounted in casing 11, as best illustrated in FIG. 4. Wiper 40 has a contact portion **40*a* against which resistive strip 33 abuts. Wiper 41 has a similar contact portion (not shown), against which strip 32 abuts. Wipers 40 and 41 are preferably made of a springy material such as beryllium copper, which will give slightly as the tape is drawn therealong and which will afford good contact with the strips. Terminals 40*b* and 41*b*** are provided on the wipers for connecting leads which run to equipment with which the device of the invention is to be utilized.

In operation, knob 22 is rotated to move the tape between the two reels to a position whereat the indicia 37 provides a desired resistance indication opposite marker 47 formed on window 25*a*. The indicia 37 are calibrated so that the readings thereon will accurately represent the actual resistances between wipers 40 and 41, which of course is determined by the resistance between the points on the strips 32 and 33 contacted by the wipers along the path interconnected by jumper 34.

Referring now to FIG. 6, an alternative configuration for the resistive strips is shown. In this configuration, the strips 32 and 33 are tapered to provide a variation in resistance vs. strip length, thereby providing a non-linear resistive scale.

FIG. 7 shows a still further configuration for the strips. In this configuration, a closed loop is formed by means of jumpers 34 and 37 which interconnect the opposite ends of strips 32 and 33. This configuration provides vernier scaling.

It should be apparent that other types of resistive variations in accordance with any particular resistive function can be provided by varying the strip width in accordance with this function.

The device of this invention thus provides a simple and economical yet highly accurate potentiometer device for providing known resistive outputs as may be desired.

While the invention has been described and illustrated in detail, it is to be clearly understood that this is intended by way of illustration and example only and is not to be taken by way of limitation, the spirit and scope of this invention being limited only by the terms of the following claims.

I claim:

1. A potentiometer comprising:

an elongated tape fabricated of an electrically insulative material, at least two elongated strips of an electrically conductive material on said tape, said strips running along the longitudinal extent of said tape opposite each other, at least one of the ends of said strips being joined together to form a loop, at least two electrical wipers fixedly mounted relative to said tape, each of said wipers being in contact with an associated one of said strips, and means for moving said tape parallel to the longitudinal axis thereof relative to said wipers, said tape having indicia marked therealong running coextensive with said strips for continuously indicating the resistance between the wipers for various positions of the tape relative to the wipers.

2. The potentiometer of claim 1 wherein the means for moving said tape comprises a pinch wheel which engages one of the longitudinal edges of the tape and means for rotatably positioning said pinch wheel.

3. The potentiometer of claim 2 wherein the means for rotatably positioning the pinch wheel comprises a knob attached to said wheel.

4. The potentiometer of claim 3 and further including a guiding means for guiding the tape which engages the other of the longitudinal edges of the tape.

5. The potentiometer of claim 1 and further including a separate reel on which each opposite end of said tape is wound, said reels being biased in opposite directions to remove slack from the tape.

6. The potentiometer of claim 1 wherein the strips have a uniform width throughout their entire extent.

7. The potentiometer of claim 1 wherein the conductive strips vary in width between their opposite ends.

8. A potentiometer comprising:

a housing, a pair of reels rotatably mounted in said housing, an elongated tape of an electrically insulative material, one end of said tape being wound on one of said reels, the other end of said tape being wound on the other of said reels with a portion of the tape extending between the reels, said reels being biased in opposite directions to take up slack in the tape, at least two elongated strips of an electrically conductive material on said tape, said strips running longitudinally of said tape opposite each other, at least one of the ends of said strips being joined together to form a loop, at least two electrical wipers fixedly mounted in said housing with each of said wipers in contact with an associated one of said strips, and means engaging one of the longitudinal edges of the tape for driving the tape between the reels relative to the wipers, said tape having indicia marked thereon running coextensive with said strips for continuously indicating the resistance of the strip portions running between said wipers, said housing having a window therein past which the indicia on said tape pass as the tape is moved and a marker for reading the values represented by said indicia which correspond to the resistance of the strip portions between the wipers.

9. The potentiometer of claim 8 wherein the means for driving the tape comprises a pinch wheel rotatably mounted on said housing, said wheel having a plurality of fingers alternately bent in opposite directions to form slots therebetween, the tape being fitted in said slots.

10. The potentiometer of claim 9 and further including a knob attached to said wheel for use in manually rotating the wheel.

11. The potentiometer of claim 9 and further including a guide means supported on the housing and engaging the other of the longitudinal edges of the tape for guiding the tape.

12. The potentiometer of claim 8 wherein the strips have a uniform width throughout their entire extent.

13. The potentiometer of claim 8 wherein the strips vary in width between their opposite ends.

* * * * *